United States Patent [19]

Chapman et al.

[11] Patent Number: 4,556,250

[45] Date of Patent: Dec. 3, 1985

[54] TRANSPORTABLE ARTICLE HOLDER FOR STADIUM-TYPE CHAIRS

[76] Inventors: Athol W. Chapman, 17112 Twain La., Huntington Beach, Calif. 92649; Fred E. Cope, 146 12th St., Seal Beach, Calif. 92640; Kenneth P. Missick, 1510 Camino Los Robles, Fullerton, Calif. 92633

[21] Appl. No.: 512,904

[22] Filed: Jul. 11, 1983

[51] Int. Cl.[4] ..... A47C 7/62

[52] U.S. Cl. ..... 297/192; 297/275

[58] Field of Search ..... 297/17, 192, 250, 252, 297/188; 224/275; 190/1, 8; 383/4

[56] References Cited

U.S. PATENT DOCUMENTS

| | | | |
|---|---|---|---|
| 473,360 | 4/1892 | Shaw | 297/192 |
| 960,360 | 6/1910 | Lynch | 297/190 |
| 1,336,641 | 4/1920 | Linke | 297/331 |
| 2,023,173 | 12/1935 | Hiener | 297/188 |
| 2,673,601 | 3/1954 | Fischer et al. | 297/192 |
| 2,754,167 | 7/1956 | Young | 108/26 |
| 2,865,433 | 12/1958 | Warner | 297/188 |
| 3,160,438 | 9/1961 | Davis | 297/192 |
| 3,180,680 | 4/1965 | Landvik | 297/192 |

FOREIGN PATENT DOCUMENTS

| | | | |
|---|---|---|---|
| 112315 | 8/1964 | Czechoslovakia | 297/192 |
| 633548 | 10/1927 | France | 297/192 |

*Primary Examiner*—William E. Lyddane
*Assistant Examiner*—Joseph Falk
*Attorney, Agent, or Firm*—K. H. Boswell

[57] ABSTRACT

An article holder for stadium type chairs includes a support member which is positioned and held underneath the seat portion of a stadium type chair by a holding sock which slips over the seat portion. A shelf is slidably attached to the support member and slides between an extended position wherein a portion of the shelf extends beyond the front edge of the seat portion of the chair and a retracted position wherein the shelf is totally underneath the seat portion. During an event wherein the stadium type chair is occupied, if the occupant of the chair has purchased a beverage, hot dog or the like and wishes to place them somewhere without fear of their being spilled, kicked or staining the occupant's clothing and the like, the shelf is simply moved from the retracted to the extended position and the beverage, hot dog or other article is placed thereon without fear of spillage or the like. After termination of the event the article holder is simply slipped off of the chair for easy transport by the occupant out of the stadium.

12 Claims, 4 Drawing Figures

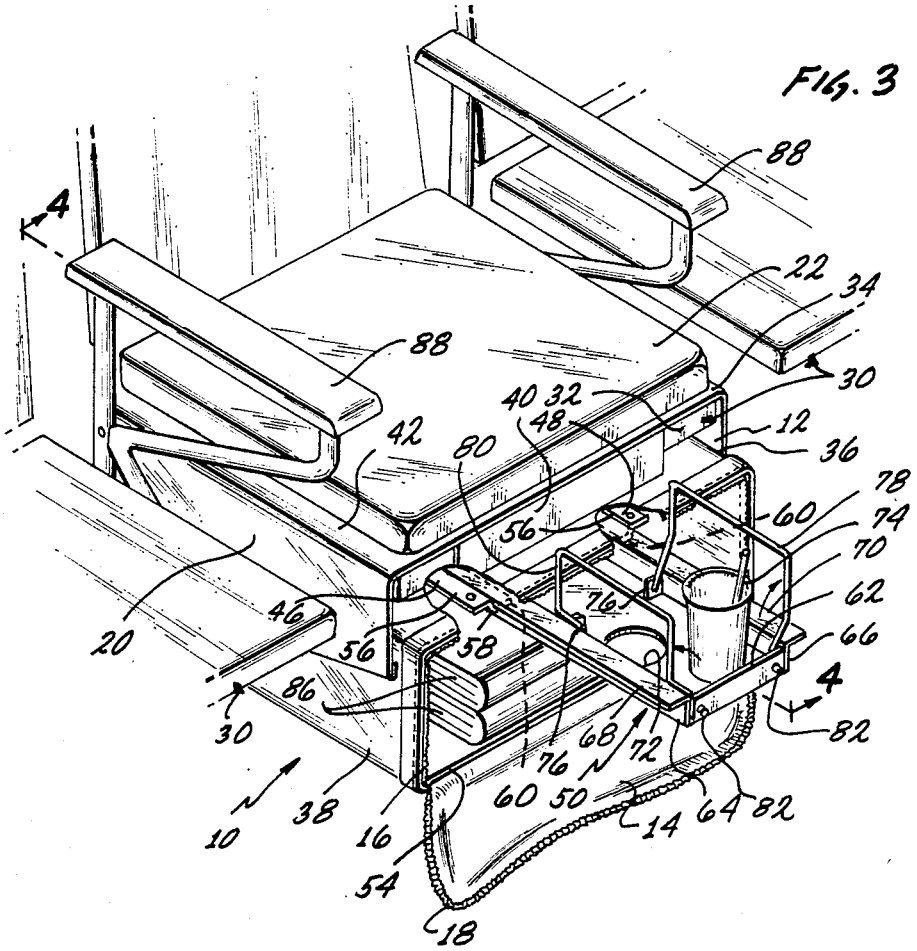
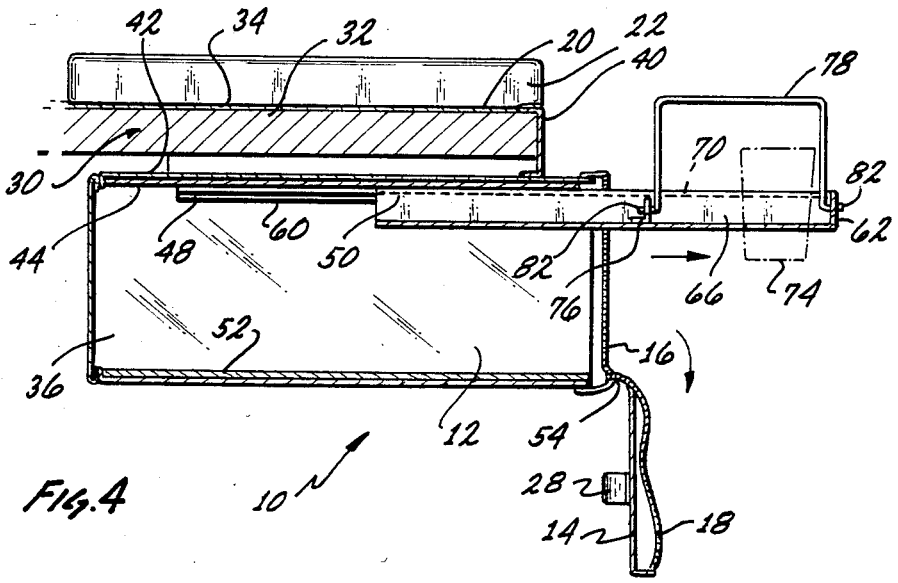
Fig. 4

TRANSPORTABLE ARTICLE HOLDER FOR STADIUM-TYPE CHAIRS

BACKGROUND OF THE INVENTION

This invention is directed to an article holder for use in conjunction with stadium type chairs. The article holder slides over the seat portion of the chair to provide a surface for holding articles such as beverage containers, as well as storing other articles, such as coats and the like.

Joined rows of chairs are utilized to provide seating in stadiums, theaters, amphitheaters and the like. Whether these chairs are individual or formed as a unit, they are generally fixed to the supporting surface such that they remain fixed in predetermined rows. Further, the seat portion of these chairs are generally hinged such that they can be put into an essentially horizontal alignment allowing for more aisle space to facilitate movement by the occupants of the chairs between rows of the chairs.

In view of the amount of foot traffic between any particular adjacent rows of chairs, and in view of spillage of beverages, food and the like on the floors, the floors of stadiums, theaters and the like normally are quite unsanitary and dirty, sticky and the like.

Because of the conditions of the floors, the occupants of the stadium type chairs are extremely hesitant in placing articles on the floors. Further, with regard to personal articles such as coats, blankets and the like which might be brought along by the occupants to the stadium, theater or the like, aside from the hesitancy of people to set these on the floor for health or cleanliness reasons, there is a further hesitancy with regard to potential theft of the articles or inadvertent forgetting of the articles upon leaving the stadium.

If the occupant of a stadium type chair at a sporting event, theater or the like purchases food or beverage, the occupant must either consume the same in less than a leisurely manner, or physically hold the article or beverage in his hand or on his lap if consumption is to be undertaken in a leisurely manner. This detracts from the pleasurable enjoyment of the food or beverage.

It has been suggested by others in the past to equip these stadium type chairs with permanent racks or shelves. This, however, has not met with acceptance for several reasons. Because of the pivotable nature of the seat of the stadium chairs between a horizontal position while sitting on the same and a vertical position to facilitate movement down the aisles, any rack or shelf so attached to these type chairs would also have to be engineered and constructed to pivot with the seat portion of the chair. Further, there has been hesitancy to incorporate such shelves to stadium chairs and the like because of vandalism to the same and/or safety reasons with regard to people tripping or the like on shelves placed close to the floor.

BRIEF DESCRIPTION OF THE INVENTION

In view of the above, it is evident that there exists a need for an article holder which can be easily and safely attached to a stadium type chair which provides for a suitable shelf space on which to rest food, beverages or the like. It is therefore a broad object of this invention to provide such an article holder. It is a further object of this invention to provide storage space wherein coats, purses and the like can be stored which is accessible only by a person occupying a stadium type chair and not other, unauthorized persons. It is a further object of this invention to provide such an article holder which is portable, lightweight and of such construction that a long and useful lifetime is assured.

These, and other objects, as will become evident from the remainder of this specification are achieved in an article holder for stadium type chairs which comprises: a support member sized and shaped so as to be positionable on the underside of the seat portion of a stadium type chair; connecting means attaching to said support member for temporarily connecting said support member to said underside portion of said seat; movable shelf means for holding articles, said shelf means movably attaching to said support member so as to move between an extended position wherein at least a portion of said shelf means extends beyond the front edge of said seat and a retracted position wherein said shelf means is located below the underside of said seat; shelf attaching means located on said support member for movably attaching said shelf means to said support means.

Preferredly, the article holder will also include a storage means attaching to the support member and extending downwardly from the support member underneath the seat when the support member is attached to the underneath side of the seat. The storage means would provide for further article storage below the seat for storing items during occupancy of the seat. Additionally, the storage means would provide a place to carry articles to and from the stadium, theater and the like prior to or after occupancy of the chair. Preferredly, the shelf means would be located within this storage means when in its retracted position with the storage means then serving as a convenient place for out of the way transportation of the shelf means.

Preferredly, the shelf means would be slidably associated with the shelf attaching means so as to slide between its extended and retracted position and preferredly would include a beverage container holding means for fixedly holding a beverage container to the shelf means so as to inhibit tipping of the beverage container.

The storge means could also include a closure means allowing for closure of the same to prohibit ingress and egress to the storage means. Preferredly, the holding means for attaching the support member to the seat would include a three sided pliable sleeve means capable of fitting over many different configurations of seat attaching to a variety of stadium type chairs, while still providing a comfortable seating platform for the occupant thereof.

BRIEF DESCRIPTION OF THE DRAWINGS

This invention will be better understood when taken in conjunction with the drawings wherein:

FIG. 3 is view similar to FIG. 2 with the exception that the article holder is in an open configuration and the shelf forming a portion thereof is extended outwardly so as to hold a beverage container;

FIG. 4 is a side elevational view in section about the line 4—4 of FIG. 3.

Figure 1:
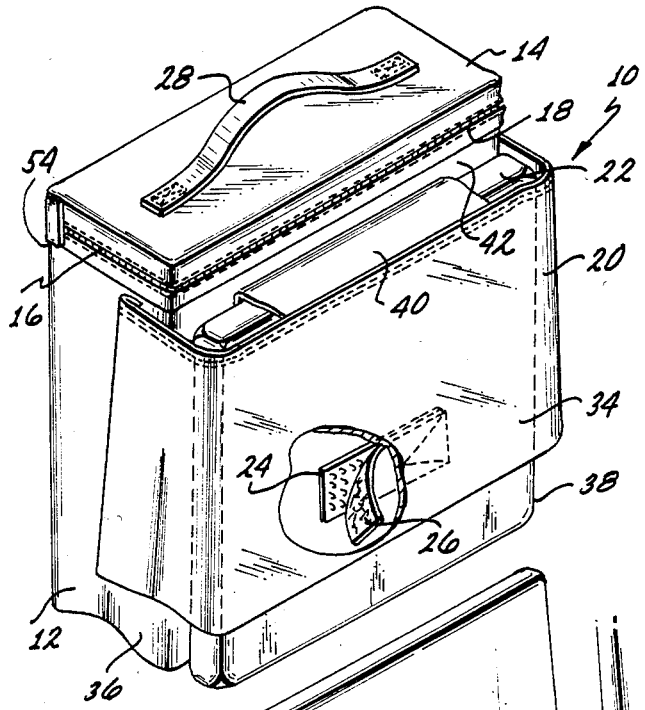
FIG. 1 is an isometric view of an article holder of the invention.
Figure 2:
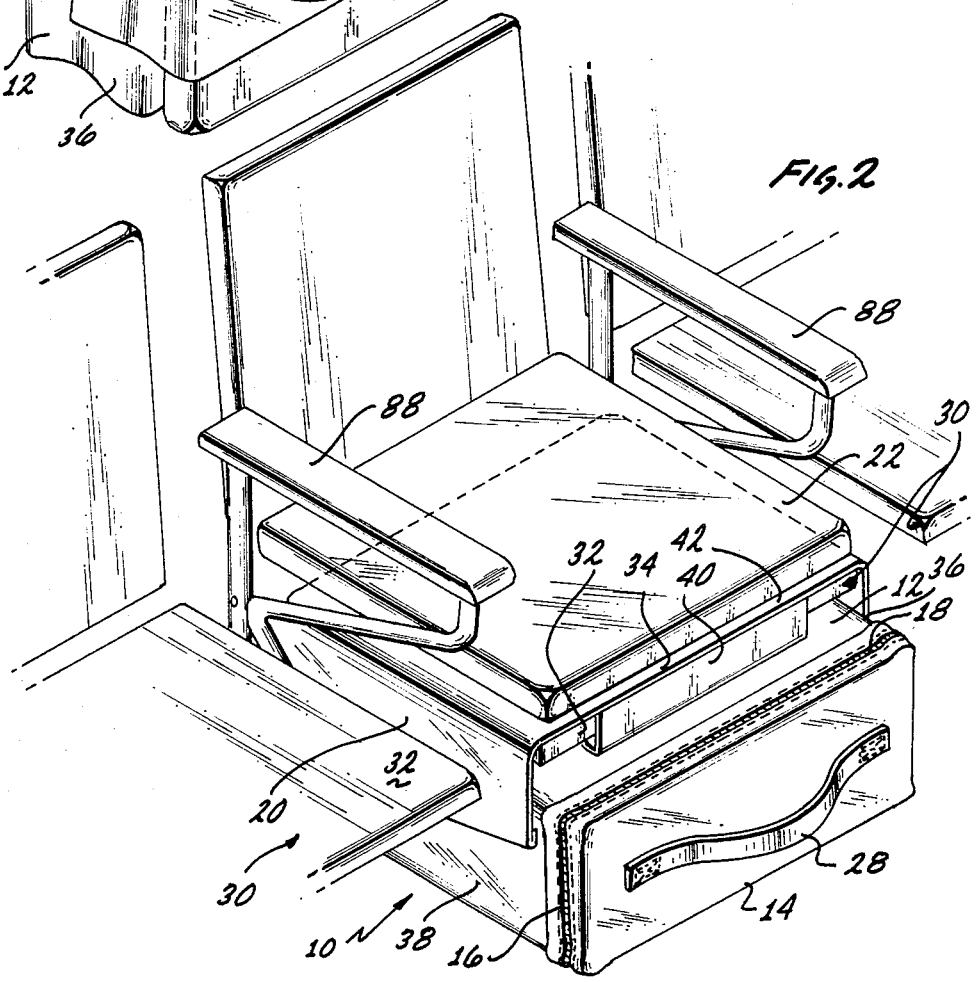
FIG. 2 is an isometric view showing location of the article holder of FIG. 1 on the seat portion of a stadium type chair with the article holder being in a closed configuration.

The invention described in this specification and shown in the drawings utilizes certain principles and/or concepts as are set forth in the claims appended to this specification. Those skilled in the arts to which this invention pertains will realize that these principles and/or concepts are capable of being applied to a number of embodiments differing from the embodiment utilized for illustrative purposes herein. For this reason, this invention is not to be construed as being limited to the exact illustrative embodiment, but is only to be construed as being limited by the claims.

DETAILED DESCRIPTION OF THE INVENTION

In FIG. 1, an illustrative article holder 10 of this invention is shown in the configuration it would be in during carrying to and from a stadium, theater or the like. The article holder 10 includes a storage compartment 12 having a cover 14 attached about edge 16 to the main body of the storage compartment 12. A zipper closure 18 serves to attach the cover 14 about the other three edges to the storage compartment 12.

A three sided sleeve 20 attaches to the storage compartment 12 and includes provision for carrying a cushion 22 therein with the cushion 22 attaching to the inside of the sleeve 20 by the use of mating Velcro straps 24 and 26.

A handle 28 is attached to the cover 14 for conveniently carrying the article holder 10 to and from the stadium, theater or the like. A plurality of articles, such as coats, blankets or the like can be enclosed within the storage compartment 12 and safely maintained there by zipping the zipper closure 18 to firmly attach the cover 14 on all four sides to the storage compartment 12. The cushion 22 is fixedly held within the sleeve 20 by the Velcro straps 24 and 26 for transportation to and from the stadium.

Once at the stadium the article holder 10 is easily and conveniently attached to a typical stadium type chair, such as chair 30, by removing the cushion 22 from the sleeve 20 and slipping the sleeve 20 over the seat portion 32 of the chair 30. The normal stadium type chairs 30 have their seat portions 32 hinged near the rear of the seat 32 such that the seat 32 can pivot upwardly to allow for greater aisle space to facilitate movement through the aisle. As such, the three sided sleeve 20 serves as a convenient attaching member for locating the article holder 10 to the underneath surface of the seat 32.

After attaching the article holder 10 to the seat 32 by simply sliding the sleeve 20 over the seat 32, the cushion 22 can then be appropriately placed on top of the sleeve 20 to augment the padding characteristics of the seat 32. For use in chairs 30 which are in outdoor stadiums and the like wherein the seat 32 is normally not padded, use of the cushion 22 would lead to more enjoyable seating in the chair 30. In those situations wherein the seat 32 would normally be padded, such as in a movie theater and the like, the user of the article holder 10 could simply leave the cushion 22 at home or the like, since it would not be needed to pad or cushion the seat 32.

The sleeve 20 and the outside of the storage compartment 12 including the cover 14 would conveniently be made of a vinyl or other type fabric which is soft and flexible and easily cared for as well as being economical. This would alow the sleeve 20 to easily adapt to many different curvatures of seats 32. While most of the seats 32 of stadium type chairs 30 are somewhat standardized in their dimensions, there is some variety with regard to the thicknesses of the same wherein some are padded, some are not, and with regard to curvatures and the like, which are meant to mimic the human anatomy in a sitting position. The use of a fabric sleeve 20 would allow for easy adaptability of the article holder 10 to a variety of different configurations of seats 32.

The sleeve 20 is conveniently formed utilizing a main piece of fabric 34 which is attached to the respective sides 36 and 38 of the storage compartment 12. A front web 40 attached between the top 42 of the storage compartment and the main fabric member 34. While presence of the front web 40 is not mandatory insofar as the main fabric member 34 is suitable by itself to support the article holder 10, its inclusion as a portion of the sleeve 20 insures maintenance of the sleeve 20 on the underneath side of the seat 32 at a fixed position, especially when the seat 32 is rotated upwardly to facilitate movement through the aisles adjacent to the stadium chair 30.

A support member 44 formed of a resilient material is located inside of the storage compartment 12 directly below the top 42. The support member 44 is preferredly formed of a resilient material in order to form a foundation to which to attach runners 46 and 48 to which is attached a slidable shelf 50.

A bottom resilient member 52 is included on the bottom inside surface of the storage compartment 12 to provide support for locating large articles, such as blankets and the like, within the storage compartment 12. The outside fabric of the storage compartment 12 is preferredly glued or sewed to the support member 44 and the bottom 52 to join the same, with the main member 34 and the web 40 of the sleeve 20 being glued or sewed to the support compartment 12. As so formed, other than the support member 44 and the bottom 52 and the shelf 50 attached to the support member 44, the remainder of the article holder 12 is collapsible for easy and convenient storage in a small space. The hinge 54 along edge 16 is formed of the fabric forming the outside surface of the storage compartment 12 and thus is simply flexed open and closed.

The runners 46 and 48 are preferredly formed of a light sheet metal or the like and are so shaped so as to have a flat portion 56 which attaches to the support member 44 by rivets or the like which then curves through curved portion 58 before culminating into a second flat section 60. The flat section 60, because of the curve 58 is spaced away from the support member 44.

The shelf 50 is preferredly formed of a light sheet metal or the like which has been cut to allow end flap 62 to be folded up and side flaps 64 and 66 first bent upwardly and then outwardly to form flanges 68 and 70. The flanges 68 and 70 are spaced in between sections 60 of the runners 46 and 48 and the support member 44 and are slidable along the sections 60 of the runners 46 and 48.

The runners 46 and 48 as seen in FIG. 4 extend inwardly into the storage compartment 12 with the length of the shelf 50 sized such that the totality of the shelf 50 can be slid into a retracted position into the storage compartment 12. When so retracted, the cover 14 can be closed to the storage compartment 12 via the zipper closure 18.

When it is desirous to use the shelf 50 the zipper closure 18 is opened allowing the cover 14 to flap open as seen in FIGS. 3 and 4. The shelf 50 can then conveniently be slid outwardly to an extended position.

The shelf 50 would normally include cutouts such as cutouts 72 which are circular in nature, allowing for insertion of beverage containers such as beverage container 74 therein. This allows for an easy and convenient way to locate the beverage container 74 on to the shelf 50 in a manner inhibiting spillage of the same.

Further, two ears, collectively identified by the numeral 76, can be riveted to the bottom pan of the shelf 50. The ears, together with the end flap 62 serve as a foundation to support two wire guards 78 and 80 which attach to the shelf 50 by insertion of their ends, collectively identified by the numeral 82, into holes, not separately numbered, formed in both the ears 76 and the end flap 62.

By so forming the guards 80 and mounting them to the shelf 50, the guards can be pivoted about their ends 80 to a flat configuration such that the shelf 50 can conveniently be slid into the storage compartment 12 to its retracted position. When the shelf 50 is extended outwardly to the position shown in FIGS. 3 and 4, the wire guards 78 and 80 can be conveniently rotated upwardly until they abutt against side flaps 64 and 66. The wire guards 78 and 80 serve to further prevent spillage of beverage containers such as container 74 when so located on the shelf 50. Additionally, the wire guards 78 and 80 form a suitable holder for popcorn bags and containers or paraphernalia which might be conveniently located between the legs of the occupant of the chair 30 while sitting in the chair 30.

As can be seen in FIG. 3 when the article holder 10 is mounted to the chair 30 by sliding over its seat 32, articles such as blankets 86 or the like can be conveniently stored in the storage compartment 12 until use of the same is desired. The storage compartment 12 further serves as a convenient place to store coats, purses and other articles which normally have to be held in one's hand or stuffed very inconveniently between one's side and the chair handles 88. As is evident, use of the storage container 12 allows for folding of coats and the like such that they are not grossly wrinkled as normally occurs when they are stuffed next to a chair handle 88 or the like, and prevents loss of article such as keys and the like which might be located in the pocket of such a coat.

Since the article holder 10 easily and conveniently attaches to the seat portion 32 of a stadium chair 30 and is fully pivotable in conjunction with pivoting of the seat portion 32, there is no necessity to remove the same if one has to stand up from the chair 30 and fold the seat upward to allow others to pass through the aisle in front of one. On the conclusion of the event which is being attended, if the shelf 50 is not already retracted, it is simply slid back into the interior of the storage compartment 12 and the cover 14 is closed by closing the zipper closure 18 such that the handle 28 is conveniently positioned slightly below the front edge of the seat 32 allowing for simple extraction of the apparatus 10 by simply lifting it up and off the seat 32 by the handle 28.

I claim:

1. An article holder for stadium type chairs which comprises:

a support member sized and shaped so as to be positionable on the underside of the seat portion of a stadium type chair;

a flexible sleeve means sized and shaped to fit across the top and along the sides of the seat portion of said stadium type chair, and to extend over said seat portion to the underside of said seat portion:

said support member operatively attached to said flexible sleeve means so as to be supported beneath and in contact with the underside of the seat portion of said stadium type chair, together said flexible sleeve means and said support member temporarily attaching to said seat portion of said stadium type chair by sliding said flexible sleeve from front to back over said seat portion of said stadium type chair to position said seat portion between said flexible sleeve means and said support member;

said support member being formed of a resilient material and said flexible sleeve being formed of a flexible material, said flexible material attaching said resilient material with said flexible material flexing to mimic the contours of said seat;

movable shelf means for holding articles, said shelf means movably attached to said support member so as to move between an extended position wherein at least a portion of said shelf means extends beyond the front edge of said seat and a retracted position wherein said shelf means is located below the underside of said seat;

shelf attaching means located on said resilient support member for movably attaching said shelf means to said resilient support member.

2. The article holder of claim 1 including:

storage means attaching to said support member and extending downwardly from said support member when said support member is attached to said seat, said storage means for storing further articles below said seat.

3. The article holder of claim 2 wherein:

said shelf means is located within said storage means when said shelf means is in said retracted position.

4. The article holder of claim 3 wherein:

said shelf means is slidably associated with said shelf attaching means so as to slide between said extended and said retracted positions.

5. The article holder of claim 1 wherein:

said shelf means includes beverage container holding means for temporarily holding a beverage container to said shelf means so as to inhibit tipping of said beverage container when said beverage container is located on said shelf means to inhibit spillage of a beverage located in said beverage container means.

6. The article holder of claim 4 wherein:

said storage means includes closure means attaching to said storage means for closing said storage means when said shelf means is located in said retracted position, said closure means inhibiting ingress and egress of said storage means.

7. The article holder of claim 1 wherein:

said shelf attaching means includes runner means located on said support member, said shelf means engaging said runner means and slidable with respect to said runner means.

8. The article holder of claim 6 further including:

handle means attaching to said closure means, said handle means providing a convenient gripping point for holding and transporting said article holder.

9. The article holder of claim 7 wherein:

said shelf means comprises an elongated shelf abutting against said resilient support member slidable along said resilient support member.

10. The article holder of claim 9 further including:

cushion means, said cushion means sized and shaped so as to fit within said sleeve means when said sleeve means is not attached to said seat, said cushion means positionable over said sleeve means when said sleeve means is attached to said seat.

11. The article holder of claim 7 wherein:

said shelf means includes flange means, said flange means interacting with said runner means to slidably mount said shelf means to said support member.

12. The article holder of claim 1 wherein:

a portion of said flexible sleeve means extends over the front edge of said seat portion of said stadium type chair to said underside of said seat portion, and further portions extend over the left and right edge respectively of said seat portion of said stadium type chairs to the underside of said seat portion of said stadium type chairs, each of said portions of said flexible sleeve means operatively attaching to said support member.

* * * * *